US012565887B2

(12) United States Patent
Zheng et al.

(10) Patent No.: US 12,565,887 B2
(45) Date of Patent: Mar. 3, 2026

(54) COMPRESSOR AND REFRIGERATION DEVICE

(71) Applicant: ANHUI MEIZHI PRECISION MANUFACTURING CO., LTD., Wuhu (CN)

(72) Inventors: Licheng Zheng, Wuhu (CN); Bo Jiang, Wuhu (CN)

(73) Assignee: ANHUI MEIZHI PRECISION MANUFACTURING CO., LTD., Wuhu (CN)

( * ) Notice: Subject to any disclaimer, the term of this patent is extended or adjusted under 35 U.S.C. 154(b) by 563 days.

(21) Appl. No.: 17/531,014

(22) Filed: Nov. 19, 2021

(65) Prior Publication Data

US 2022/0090596 A1 Mar. 24, 2022

Related U.S. Application Data

(63) Continuation of application No. PCT/CN2020/099160, filed on Jun. 30, 2020.

(30) Foreign Application Priority Data

Nov. 29, 2019 (CN) ..... 201911201685.5

(51) Int. Cl.
*F04B 53/00* (2006.01)
*F04B 39/00* (2006.01)
(Continued)

(52) U.S. Cl.
CPC ..... *F04B 53/006* (2013.01); *F04B 39/0094* (2013.01); *F04B 39/128* (2013.01);
(Continued)

(58) Field of Classification Search
CPC .. F04B 53/006; F04B 39/0094; F04B 39/128; F04B 53/14; F04C 2240/50;
(Continued)

(56) References Cited

U.S. PATENT DOCUMENTS 6,168,403 B1 * 1/2001 Bush ..... F04C 29/0057 384/192
6,749,339 B1 * 6/2004 Murabe ..... H02K 7/086 384/100
(Continued)

FOREIGN PATENT DOCUMENTS

CN 203130513 U 8/2013
CN 103782036 A * 5/2014 ..... F04C 18/356
(Continued)

OTHER PUBLICATIONS

CN108278209A translation (Year: 2024).*
(Continued)

*Primary Examiner* — David N Brandt
(74) *Attorney, Agent, or Firm* — Scully, Scott, Murphy & Presser, P.C.

(57) ABSTRACT

A compressor and a refrigeration device are provided. The compressor has a crankshaft, a connecting structure, and an avoidance part arranged on the connecting structure and/or the crankshaft. The avoidance part is located at a position where the connecting structure is matched with the crankshaft. The avoidance part is configured to be suitable for avoiding at least one of the connecting structure and the crankshaft. A gap between the crankshaft and the connecting structure is increased through the arrangement of the avoidance part, so that the avoidance part can avoid the crankshaft when the crankshaft is obliquely deformed.

15 Claims, 7 Drawing Sheets

(51) Int. Cl.
*F04B 39/12* (2006.01)
*F04B 53/14* (2006.01)
*F25B 31/02* (2006.01)

(52) U.S. Cl.
CPC ..... *F04B 53/14* (2013.01); *F04C 2240/50* (2013.01); *F04C 2240/601* (2013.01); *F04C 2250/00* (2013.01); *F25B 31/026* (2013.01); *F25B 2600/021* (2013.01)

(58) Field of Classification Search
CPC ..... F04C 2240/60; F04C 2240/601; F04C 2250/00; F04C 18/356; F25B 31/026; F25B 2600/021
See application file for complete search history.

(56) References Cited

U.S. PATENT DOCUMENTS

| | | | | |
|---|---|---|---|---|
| 2019/0368493 | A1* | 12/2019 | Kumakura | F04C 29/023 |
| 2021/0340967 | A1* | 11/2021 | Ishida | F04B 53/006 |

FOREIGN PATENT DOCUMENTS

| | | | | | |
|---|---|---|---|---|---|
| CN | 205689604 | U | | 11/2016 | |
| CN | 107435622 | A | | 12/2017 | |
| CN | 108278209 | A | * | 7/2018 | F04C 23/02 |
| CN | 108368849 | A | | 8/2018 | |
| CN | 207795579 | U | | 8/2018 | |
| CN | 210949139 | U | | 7/2020 | |
| JP | 2003003959 | A | | 1/2003 | |
| JP | 2010031732 | A | | 2/2010 | |
| JP | 2011179453 | A | | 9/2011 | |
| JP | 2016089625 | A | | 5/2016 | |
| JP | 2018087528 | A | | 6/2018 | |
| JP | 2018123691 | A | | 8/2018 | |

OTHER PUBLICATIONS

CN103782036A translation (Year: 2024).*
Office Action dated Sep. 26, 2023 received in European Patent Application No. EP 20894567.5.
Notice of Reasons for Refusal dated Nov. 15, 2023 received in Japanese Patent Application No. JP 2021-571640.
International Search Report dated Oct. 10, 2020 received in International Application No. PCT/CN2020/099160 together with an English language translation.
Supplementary European Search Report dated Jul. 12, 2022 received in European Patent Application No. EP 20894567.5.
First Office Action dated Aug. 31, 2024 received in Chinese Patent Application No. 201911201685.5.
Wang, Y., "Design of High Efficiency Rotary Compressor", Proceedings of the 2018 China Household Appliance Technology Conference, Oct. 30, 2018, pp. 1329-1332 with English language abstract.
Written Opinion and Search Report dated May 28, 2024 received in Singapore Patent Application No. SG 11202113197V.

* cited by examiner

-Prior Art-

-Prior Art-

COMPRESSOR AND REFRIGERATION DEVICE

CROSS-REFERENCE TO RELATED APPLICATIONS

The present application is a continuation application of PCT International Application No. PCT/CN2020/099160, filed on Jun. 30, 2020, which claims priority to and benefits of Chinese Patent Application No. 201911201685.5 filed with China National Intellectual Property Administration on Nov. 29, 2019 and entitled "Compressor And Refrigeration Device", the entire contents of which are incorporated herein by reference for all purposes. No new matter has been introduced.

FIELD

The present disclosure relates to the technical field of refrigeration devices, and particularly relates to a compressor and a refrigeration device having the same.

BACKGROUND

At present, as shown in FIG. 1 and FIG. 2, a compressor 100' comprises a crankshaft 102'. The crankshaft 102' comprises a main shaft part 1020', an auxiliary shaft part 1022' and an eccentric part 1024'. A main bearing 104' is sleeved on the main shaft part 1020', an auxiliary bearing 106' is sleeved on the auxiliary shaft part 1022', a cylinder 108' comprises a cylinder chamber, a piston 114' is arranged in the cylinder chamber and is sleeved on the eccentric part 1024', a rotor 110' is connected with the main shaft part 1020', and a balance block 112' is arranged on the rotor 110'. As shown in FIG. 2, the reliability problems, such as abnormal wear and the like, are most likely caused at the position where the main shaft part 1020' is matched with the main bearing 104', the position where the auxiliary shaft part 1022' is matched with the auxiliary bearing 106', and the position where the eccentric part 1024' is matched with the piston 114'. As shown in FIG. 2, the position A' represents the part where the wear of the main shaft part 1020' and the main bearing 104' is readily caused. In order to ensure the reliability of kinematic pairs at the matching positions, a larger shaft diameter and a longer bearing can be adopted in the prior art as the only option, thereby leading to enlargement of the volume of the compressor 100', increasing of the cost and increasing of the friction loss.

SUMMARY

The present disclosure aims to solve at least one of technical problems existing in the prior art or related technologies.

To this end, a first aspect of the present disclosure provides a compressor.

A second aspect of the present disclosure provides a refrigeration device.

According to first aspect of the present disclosure, the compressor comprises a crankshaft and a connecting structure arranged on the crankshaft. An avoidance part is arranged on the connecting structure and/or the crankshaft. The avoidance part is located at a position where the connecting structure is matched with the crankshaft. The avoidance part is configured to be suitable for avoiding at least one of the connecting structure and the crankshaft.

The compressor provided by the present disclosure comprises the crankshaft and the connecting structure connected with the crankshaft. The avoidance part is arranged on the connecting structure and/or the crankshaft. The avoidance part is used for avoiding at least one of the connecting structure and the crankshaft. A gap between the crankshaft and the connecting structure is increased through the arrangement of the avoidance part, so that the avoidance part can avoid the oblique crankshaft when the crankshaft is obliquely deformed. Thus, the crankshaft and the connecting structure can keep surface contact with each other, and an oil film between the crankshaft and the connecting structure is not damaged, thereby effectively ensuring the reliability of the compressor. Therefore, a smaller axle diameter and a shorter axle sleeve can be used, thereby reducing the dimension and the cost of the compressor, reducing the friction loss of the part where the crankshaft is matched with the connecting structure, and improving the performance of the compressor.

The avoidance part is used for avoiding at least one of the connecting structure and the crankshaft, and namely, the avoidance part is used for avoiding oblique deformation of the crankshaft, thereby ensuring that the contact between the crankshaft corresponding to the avoidance part and the connecting structure is surface contact once the crankshaft is oblique.

In addition, the compressor provided by the present disclosure may also have the additional technical features as follows.

In the above embodiment, the gap is formed between the crankshaft and the connecting structure, and the gap corresponding to the avoidance part is enlarged in the direction away from the middle part of the connecting structure along the axial direction of the crankshaft.

In the embodiment, the gap is formed between the crankshaft and the connecting structure, and lubricating oil can be distributed in the gap. The gap corresponding to the avoidance part is enlarged in the direction away from the middle part of the connecting structure along the axial direction of the crankshaft, thus an avoidance space is formed to accommodate deformation of the crankshaft by the gradually enlarged gap when the crankshaft is obliquely deformed, and the contact between the crankshaft and the connecting structure becomes the surface contact, thereby ensuring the normal work of an oil film, avoiding the wear between the crankshaft and the connecting structure and improving the reliability of the compressor.

In any of the above embodiments, in the compressor, the sum of gaps at the two sides of the axis of the crankshaft is defined as a bilateral gap at the same axial height in the cross section in the axial direction of the crankshaft; the minimum value of the bilateral gap corresponding to the avoidance part is $\delta_0$, the difference between the maximum value of the bilateral gap corresponding to the avoidance part and $\delta_0$ is $\delta$, the diameter of the crankshaft corresponding to the minimum part of the bilateral gap corresponding to the avoidance part is D, and the length of the avoidance part is h along the axial direction of the crankshaft, wherein the product of $\delta/\delta_0$ and D/h is larger than or equal to 0.2 and less than or equal to 5.

In the embodiment, the avoidance part is gradually enlarged along the direction from the middle part of the connecting structure to the end part of the connecting structure. Thus the bilateral gap corresponding to the avoidance part has the minimum value and the maximum value, the minimum value of the bilateral gap corresponding to the avoidance part is $\delta_0$, the difference between the maximum value of the bilateral gap corresponding to the avoidance part and $\delta_0$ is $\delta$, the diameter of the crankshaft corresponding to the minimum part of the bilateral gap corresponding to the avoidance part is D, the length of the avoidance part is h along the axial direction of the crankshaft, and the reduction of the friction between the crankshaft and the connecting structure is affected by the corresponding dimension of the avoidance part. Therefore, the product of $\delta/\delta_0$ and D/h is set as larger than or equal to 0.2 and less than or equal to 5, and the reduction of the friction between the crankshaft and the connecting structure due to the avoidance part is the optimal.

In any of the above embodiments, the avoidance part comprises a plurality of avoidance sections, and the plurality of avoidance sections are sequentially connected with one another along the axial direction of the crankshaft, wherein at least one of the avoidance sections satisfies the condition that the product of $\delta/\delta_0$ and D/h is larger than or equal to 0.2 and less than or equal to 5.

In the embodiment, the avoidance part comprises a plurality of avoidance sections, the avoidance sections are sequentially connected with one another along the axial direction, and the dimension of at least one of the avoidance sections satisfies a relational expression that the product of $\delta/\delta_0$ and D/h is larger than or equal to 0.2 and less than or equal to 5.

In any of the above embodiments, the product of $\delta/\delta_0$ and D/h is larger than or equal to 0.5 and less than or equal to 2.5.

In the embodiment, when the product of $\delta/\delta_0$ and D/h is set as larger than or equal to 0.5 and less than or equal to 2.5, the reduction of the friction between the crankshaft and the connecting structure is better.

In any of the above embodiments, h is larger more than or equal to 2 mm and less than or equal to 20 mm.

In the embodiment, the axial height h of the avoidance part is set as larger than or equal to 2 mm and less than or equal to 20 mm, thereby being convenient for processing of the avoidance part, and meanwhile, being beneficial for reduction of wear between the crankshaft and the connecting structure.

In any of the above embodiments, the dimension of the gap corresponding to at least part of the avoidance part changes linearly along the axial direction of the crankshaft.

In the embodiment, the dimension of the gap corresponding to at least part of the avoidance part changes linearly along the axial direction of the crankshaft, and namely, in the compressor, the radial dimension of the gap from the direction away from the middle part of the connecting structure along the axial direction of the crankshaft in the cross section in the axial direction of the crankshaft changes in direct proportion.

In any of the above embodiments, a wall surface formed by the avoidance part comprises a conical surface.

In the embodiment, the wall surface formed by the avoidance part comprises the conical surface, thereby enabling the gap between the crankshaft and the connecting structure to change linearly, and meanwhile, being convenient for forming the avoidance part.

In any of the above embodiments, in the compressor, an acute angle between a tangent line of the wall surface formed by at least part of the avoidance part and the direction perpendicular to the axis of the crankshaft is gradually reduced along the direction far away from the middle part of the connecting structure in the cross section in the axial direction of the crankshaft.

In the embodiment, the tangent line of the wall surface formed by at least part of the avoidance part gradually tends to be horizontal along the direction far away from the middle part of the connecting structure in the axial direction of the crankshaft, and namely, the acute angle between the tangent line of the wall surface formed by the avoidance part and the direction perpendicular to the axis of the crankshaft is gradually reduced, so that the avoidance part is better matched with the shape of deflection deformation of the crankshaft, thereby further reducing wear.

In any of the above embodiments, the wall surface formed by the avoidance part comprises a curved surface.

In the embodiment, the wall surface formed by the avoidance part comprises the curved surface, so that the change of the gap corresponding to the avoidance part is better matched with the shape of deflection deformation of the crankshaft, thereby further reducing wear.

In any of the above embodiments, the avoidance part is annular in the cross section perpendicular to the axis of the crankshaft.

In the embodiment, the avoidance part is annular, and the annular avoidance part can have good avoidance effect on all directions of the crankshaft when the crankshaft is obliquely deformed, thereby reducing wear between the crankshaft and the connecting structure in all directions, and namely, reducing the degree of wear in all directions.

In any of the above embodiments, the crankshaft comprises a main body and an eccentric part; the main body comprises a first shaft part and a second shaft part that are coaxially arranged; the eccentric part is connected with the main body, and the main body and the eccentric part are eccentrically arranged.

In the embodiment, the crankshaft comprises the main body and the eccentric part, the main body comprises the first shaft part and the second shaft part, the first shaft part is connected with a rotor of a motor to drive the eccentric part to rotate, and a suction process and an exhaust process of the compressor are realized through the rotation of the eccentric part.

In any of the above embodiments, the connecting structure comprises a first bearing, a second bearing and a piston, the first bearing is sleeved on the first shaft part, the second bearing is sleeved on the second shaft part, and the piston is sleeved on the eccentric part.

In the embodiment, the connecting structure comprises the first bearing, the second bearing and the piston. The first bearing is sleeved on the first shaft part, the second bearing is sleeved on the second shaft part, the crankshaft is fixed through the first bearing and the second bearing, the piston is sleeved on the eccentric part, and the piston is driven to move through the rotation of the eccentric part, so that the suction process and the exhaust process of the compressor are realized.

In any of the above embodiments, based on the condition that the avoidance part is arranged on the crankshaft, the avoidance part is arranged at the portion of the first shaft part that is close to the second shaft part, and/or the avoidance part is arranged at the portion of the first shaft part that is away from the second shaft part, and/or the avoidance part is arranged at one end of the eccentric part that is close to the first bearing, and/or the avoidance part is arranged at one end of the eccentric part that is close to the second bearing, and/or the avoidance part is arranged at one end of the second shaft part that is close to the eccentric part.

In the embodiment, when the avoidance part is arranged on the crankshaft, the avoidance part is arranged at the part of the first shaft part that is close to the second shaft part, the part of the first shaft part that is away from the second shaft part, the end of the eccentric part that is close to the first bearing, the end of the eccentric part that is close to the second bearing, and/or the end of the second shaft part that is close to the eccentric part.

In any of the above embodiments, based on the condition that the avoidance part is arranged on the connecting structure, the avoidance part is arranged at one end of the first bearing that is close to the second bearing, and/or the avoidance part is arranged at one end of the first bearing that is away from the second bearing, and/or the avoidance part is arranged at one end of the piston that is close to the first bearing, and/or the avoidance part is arranged at one end of the piston that is close to the second bearing, and/or the avoidance part is arranged at one end of the second bearing that is close to the first bearing.

In the embodiment, when the avoidance part is arranged on the connecting structure, the avoidance part is arranged at any one or the combination of the end that the first bearing is close to the second bearing, the end that the first bearing is away from the second bearing, the end that the piston is close to the first bearing, the end that the piston is close to the second bearing, and the end that the second bearing is close to the first bearing.

Certainly, the avoidance part can be also arranged on the connecting structure and the crankshaft at the same time.

In any of the above embodiments, the compressor also comprises a cylinder, a sliding piece and a rotor. The cylinder comprises a cylinder chamber, the piston is arranged in the cylinder chamber, the crankshaft is arranged in the cylinder chamber in a penetrating manner, a sliding piece groove is formed in the cylinder, the sliding piece is arranged in the sliding piece groove and is connected with the piston in a rolling manner, and the rotor is connected with the first shaft part.

In the embodiment, the compressor also comprises the cylinder, the sliding piece and the rotor, the rotor is connected with the first shaft part, the cylinder is provided with the cylinder chamber, the piston is arranged in the cylinder chamber, and the crankshaft is arranged in the cylinder chamber in a penetrating manner, wherein the sliding piece groove is formed in the cylinder, and the sliding piece is arranged in the sliding piece groove and is rotatably connected with the piston, so that the suction process and the exhaust process of the compressor are realized.

In any of the above embodiments, the compressor is an inverter compressor.

In the embodiment, the compressor is the inverter compressor, the reliability of the inverter compressor can be improved in a way that the avoidance part is arranged on the connecting structure or the crankshaft, and certainly, the compressor can be also a constant speed compressor.

In any of the above embodiments, the compressor is filled with coolants, and the coolants are difluoromethane or propane.

In the embodiment, the compressor is filled with the coolants, the refrigeration or heating of the refrigeration device is realized through a heat adsorption process and a heat release process of the coolants, for example, the coolants are difluoromethane or propane, and the coolants can also be other coolants.

According to the second aspect of the present disclosure, the present disclosure also provides the refrigeration device, which comprises the compressor in any of the above embodiments.

The refrigeration device provided by the second aspect of the present disclosure comprises the compressor provided in any of the above embodiments, therefore, the refrigeration device has all beneficial effects of the compressors.

For example, the refrigeration device comprises a heat exchanger, the heat exchanger is communicated with the compressor by a pipeline, and the coolants can flow in the pipeline.

Additional aspects and advantages of the present disclosure will be apparent from the following description, or may be learned by practice of the present disclosure.

BRIEF DESCRIPTION OF THE DRAWINGS

The above and/or additional aspects and advantages of the present disclosure will become obvious and easy to understand from the description of the embodiments in conjunction with the following drawings, wherein.

Figure 1:
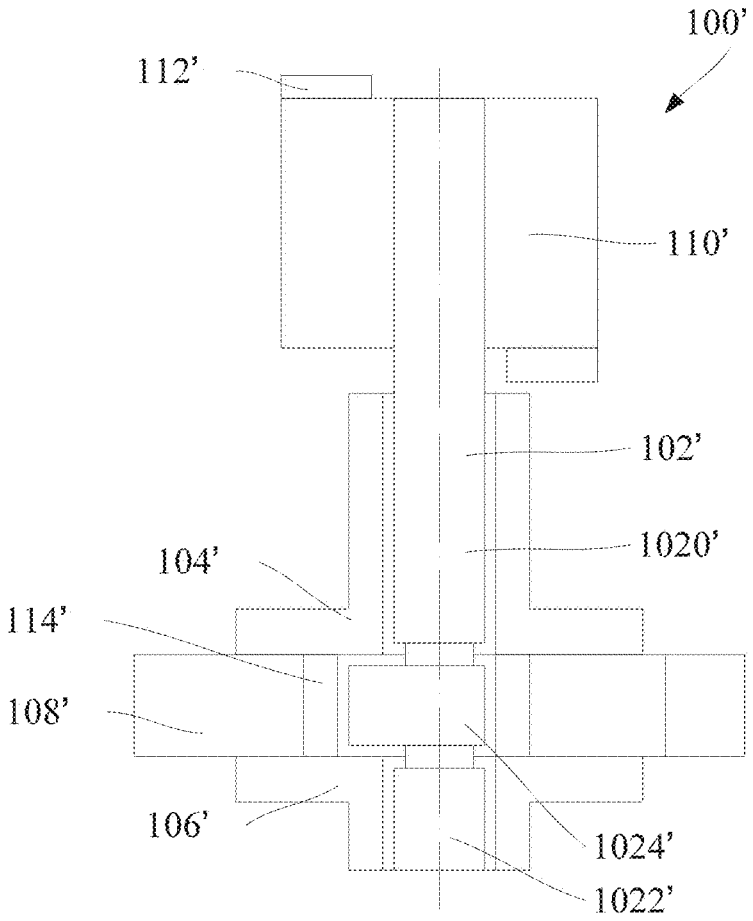
FIG. 1 is a structural schematic diagram of a compressor in the relevant technology.
Figure 2:
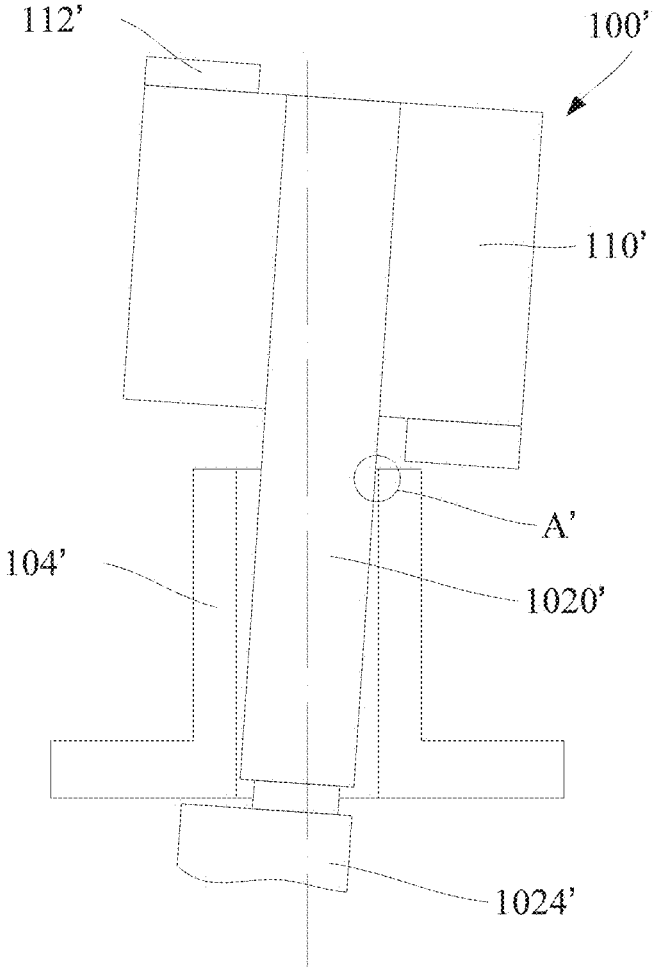
FIG. 2 is another structural schematic diagram of the compressor in the relevant technology.

Wherein the corresponding relations between marks and names of parts in drawings in FIG. 1 and FIG. 2 are described below:

100' compressor, 102' crankshaft, 1020' main shaft part, 1022' auxiliary shaft part, 1024' eccentric part, 104' main bearing, 106' auxiliary bearing, 108' cylinder, 110' rotor, 112' balance block, 114' piston.

Figure 3:
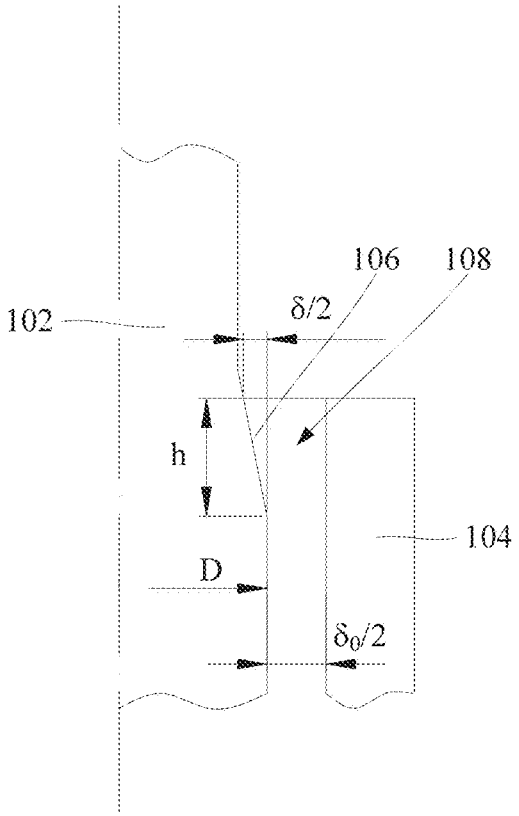
Figure 4:
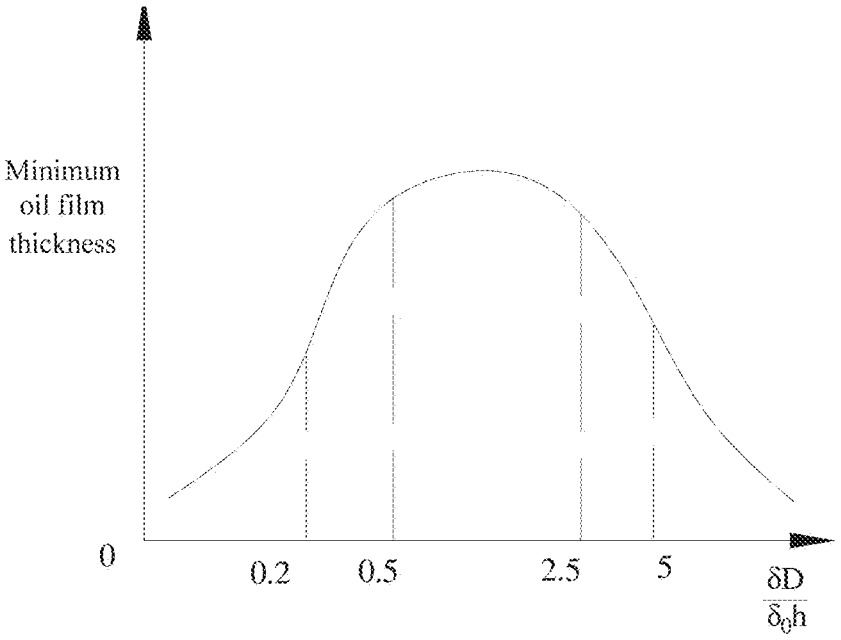
Figure 5:
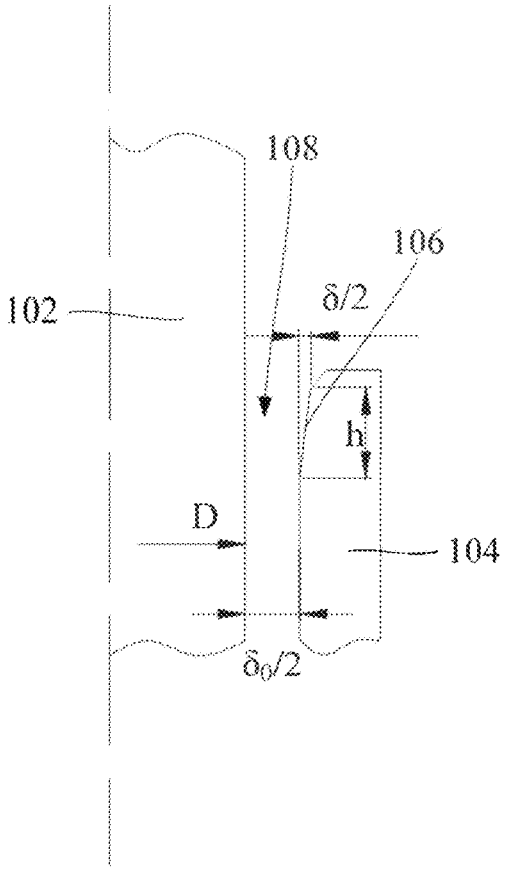
Figure 6:
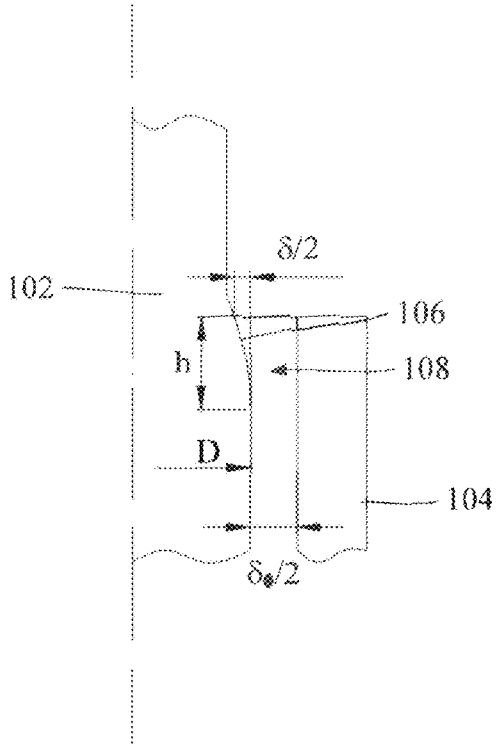
Figure 7:
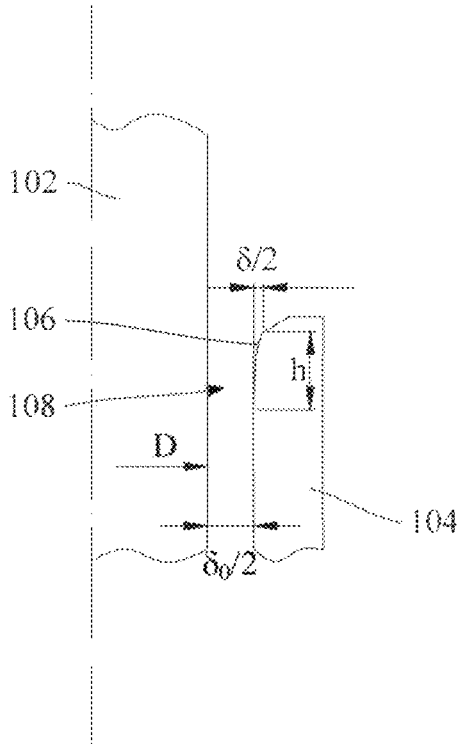
Figure 8:
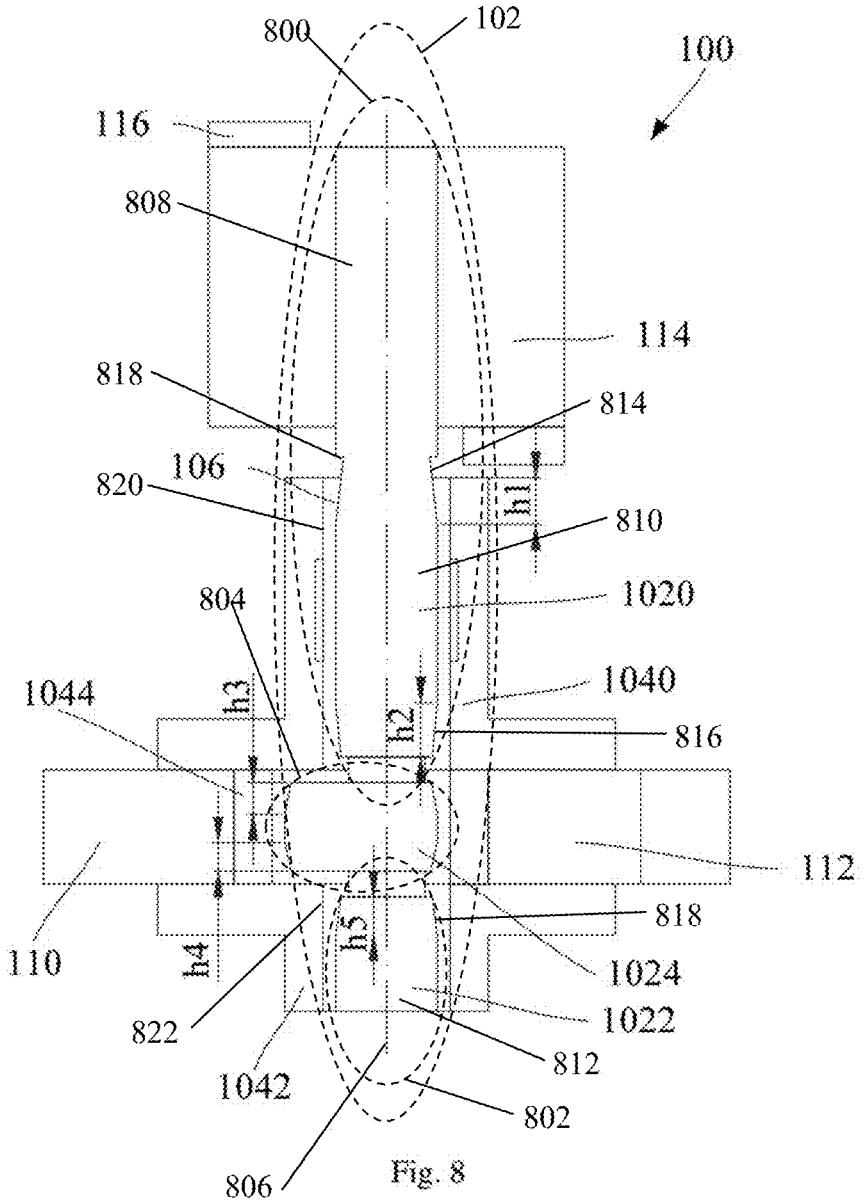
Figure 9:
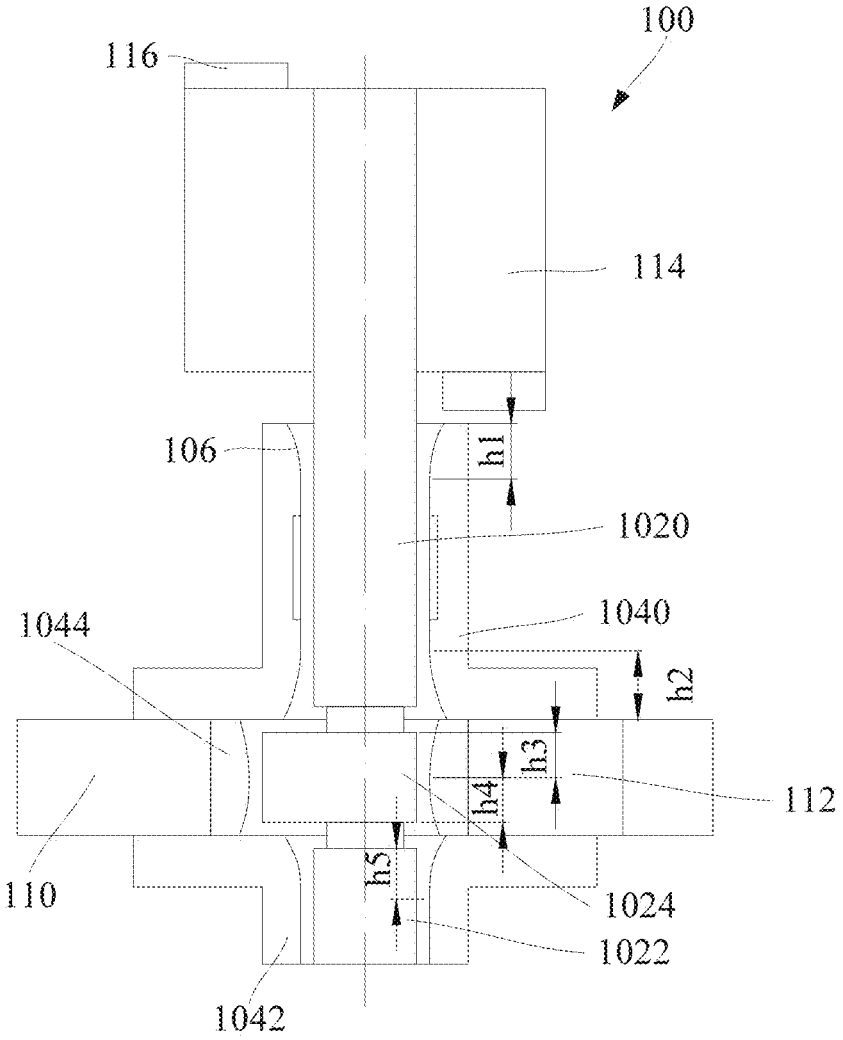

FIG. 3 is a structural schematic diagram of an embodiment of the present disclosure, in which an avoidance part is a conical surface;

FIG. 4 is a relationship diagram of a curve between an avoidance part and minimum oil film thickness in one embodiment of the present disclosure;

FIG. 5 is another structural schematic diagram of one embodiment of the present disclosure, in which an avoidance part is a conical surface;

FIG. 6 is a structural schematic diagram of one embodiment of the present disclosure, in which an avoidance part is a curved surface;

FIG. 7 is another structural schematic diagram of one embodiment of the present disclosure, in which an avoidance part is a curved surface;

FIG. 8 is a structural schematic diagram of a compressor in an exemplary embodiment of the present disclosure; and FIG. 9 is a structural schematic diagram of a compressor in another exemplary embodiment of the present disclosure.

Wherein the correspondence between the reference numerals and the component names in FIGS. 3 to 9 is:

100 compressor, 102 crankshaft, 1020 first shaft part, 1022 second shaft part, 1024 eccentric part, 104 connecting structure, 1040 first bearing, 1042 second bearing, 1044 piston, 106 avoidance part, 108 gap, 110 cylinder, 112 sliding piece, 114 rotor, 116 balance block.

DETAILED DESCRIPTION OF EMBODIMENTS

In order that the above objects, features, and advantages of the present disclosure may be more clearly understood, the present disclosure will be described in further detail with reference to the accompanying drawings and preferred embodiments. It should be noted that the embodiments and features in the embodiments of the present disclosure may be combined with one another without conflict.

In the following description, many specific details are set forth in order to fully understand the present disclosure. However, the present disclosure can also be implemented in other ways different from those described herein. Therefore, the scope of the present disclosure is not limited by exemplary embodiments disclosed below.

A compressor 100 and a refrigeration device according to embodiments of the present disclosure are described with the reference of FIG. 3 to FIG. 9.

Embodiment 1

As shown in FIG. 3, according to one embodiment of the present disclosure, the present disclosure provides a compressor 100, which comprises a crankshaft 102 and a connecting structure 104.

For example, the connecting structure 104 is arranged on the crankshaft 102, wherein an avoidance part 106 is arranged on the connecting structure 104 and/or the crankshaft 102, the avoidance part 106 is located at the part where the connecting structure 104 is matched with the crankshaft 102, and the avoidance part 106 is configured to be suitable for avoiding at least one of the connecting structure 104 and the crankshaft 102.

The compressor 100 provided by the present disclosure comprises the crankshaft 102 and the connecting structure 104 connected with the crankshaft 102, wherein the avoidance part 106 is arranged on the connecting structure 104 and/or the crankshaft 102, the avoidance part 106 is used for avoiding at least one of the connecting structure 104 and the crankshaft 102, and a gap 108 between the crankshaft 102 and the connecting structure 104 is increased through the arrangement of the avoidance part 106, so that the avoidance part 106 can avoid the oblique crankshaft 102 when the crankshaft 102 is obliquely deformed, thus the crankshaft 102 and the connecting structure 104 can keep in surface contact, and an oil film between the crankshaft 102 and the connecting structure 104 is not damaged, thereby effectively ensuring the reliability of the compressor 100. Therefore, a smaller axle diameter and a shorter axle sleeve can be used, thereby reducing the volume and the cost of the compressor 100, reducing the friction loss at the part where the crankshaft 102 is matched with the connecting structure 104, and improving the performance of the compressor 100.

The avoidance part 106 is used for avoiding at least one of the connecting structure 104 and the crankshaft 102, and namely, the avoidance part 106 is used for avoiding oblique deformation of the crankshaft 102, thus ensuring the contact between the crankshaft 102 corresponding to the avoidance part 106 and the connecting structure 104 to be surface contact once the crankshaft 102 is oblique.

For example, when the avoidance part 106 is not arranged, the contact between the crankshaft 102 and the connecting structure 104 is line contact if the crankshaft 102 is obliquely deformed, the local oil film is cracked, and metal contact is directly caused between the crankshaft 102 and the connecting structure 104, so as to easily cause wear; and after the avoidance part 106 is arranged, the contact between the crankshaft 102 and the connecting structure 104 is still the surface contact if the crankshaft 102 is obliquely deformed, thereby ensuring the normal work of the oil film, so as to reduce the degree of wear between the crankshaft 102 and the connecting structure 104 and improve the reliability of the compressor 100.

For example, based on the condition that the avoidance part 106 is arranged on the connecting structure 104, the shape of the avoidance part 106 matches the shape of the outer side wall of the corresponding oblique crankshaft 102; and based on the condition that the avoidance part 106 is arranged on the crankshaft 102, the shape of the avoidance part 106 matches the shape of the inner side wall of the connecting structure 104 once the crankshaft 102 is oblique.

For example, the avoidance part 106 is arranged at the end part of the connecting structure 104 and/or arranged at the part of the crankshaft 102, which corresponds to the end part of the connecting structure 104.

For example, the avoidance part 106 is arranged on the periphery of the end part of the connecting structure 104 and/or arranged on the periphery of the part of the crankshaft 102, which corresponds to the end part of the connecting structure.

For example, when the avoidance part 106 is arranged on the connecting structure 104, at least part of the avoidance part 106 is arranged on the inner side wall of the connecting structure 104.

Embodiment 2

As shown in FIG. 3, one embodiment according to the present disclosure comprises the features limited by the above embodiment, and further, the gap 108 is formed between the crankshaft 102 and the connecting structure 104, and the gap 108 corresponding to the avoidance part 106 is enlarged in the direction away from the middle part of the connecting structure 104 along the axial direction of the crankshaft 102.

In the embodiment, the gap 108 is formed between the crankshaft 102 and the connecting structure 104, and lubricating oil can be distributed in the gap 108, wherein the gap 108 corresponding to the avoidance part 106 is enlarged in the direction away from the middle part of the connecting structure 104 along the axial direction of the crankshaft 102, thus an avoidance space is formed for the crankshaft 102 by the gradually enlarged gap 108 when the crankshaft 102 is obliquely deformed, and the contact between the crankshaft 102 and the connecting structure 104 becomes surface contact, thereby ensuring the normal work of an oil film, avoiding the wear between the crankshaft 102 and the connecting structure 104 and improving the reliability of the compressor 100.

For example, the connecting structure 104 can comprise two end parts and a middle part arranged between the two end parts. The gap 108 corresponding to the avoidance part 106 is gradually enlarged along the direction away from the middle part of the connecting structure 104, so as to be suitable for the shape of the crankshaft 102 once the crankshaft 102 is obliquely deformed.

For example, when the avoidance part 106 is arranged on the connecting structure 104, the avoidance part 106 is arranged at the end part of the connecting structure 104, and the avoidance part 106 is obliquely arranged on the radial outer side of the connecting structure 104 along the direction away from the middle part of the connecting structure 104 in the axial direction of the crankshaft 102. When the avoidance part 106 is arranged on the crankshaft 102, the avoidance part 106 is arranged at the part of the crankshaft 102, which corresponds to the end part of the connecting structure 104, and the avoidance part 106 is oblique to the axial direction of the crankshaft 102 along the direction of the middle part of the connecting structure 104 in the axial direction of the crankshaft 102.

Embodiment 3

One embodiment according to the present disclosure comprises the features of the above embodiments, and further, in the compressor 100, the sum of gaps 108 at the two sides of the axis of the crankshaft 102 is defined as a bilateral gap at the same axial height in the cross section in the axial direction of the crankshaft 102. The minimum value of the bilateral gap 108 corresponding to the avoidance part 106 is $\delta_0$, the difference between the maximum value of the bilateral gap 108 corresponding to the avoidance part 106 and $\delta_0$ is $\delta$, the diameter of the crankshaft 102 corresponding to the minimum part of the bilateral gap 108 corresponding to the avoidance part 106 is D, and the length of the avoidance part 106 is h along the axial direction of the crankshaft 102, wherein the product of $\delta/\delta_0$ and D/h is larger than or equal to 0.2 and less than or equal to 5.

In the embodiment, the avoidance part 106 is gradually enlarged along the direction from the middle part of the connecting structure 104 to the end part of the connecting structure 104, thus the bilateral gap 1086 corresponding to the avoidance part 108 has the minimum value and the maximum value, the minimum value of the bilateral gap 108 corresponding to the avoidance part 106 is $\delta_0$, the difference between the maximum value of the bilateral gap 108 corresponding to the avoidance part 106 and $\delta_0$ is $\delta$, the diameter of the crankshaft 102 corresponding to the minimum part of the bilateral gap 108 corresponding to the avoidance part 106 is D, the length of the avoidance part 106 is h along the axial direction of the crankshaft 102, and the reduction of the friction between the crankshaft 102 and the connecting structure 104 is affected by the corresponding dimension of the avoidance part 106, therefore, the product of $\delta/\delta_0$ and D/h is set as larger than or equal to 0.2 and less than or equal to 5, and at the moment, the reduction of the friction between the crankshaft 102 and the connecting structure 104 by the avoidance part is the optimal.

For example, $\delta_0/2$ is the half of the bilateral gap 108 corresponding to the avoidance part 106, and $\delta/2$ is the half of the difference between the maximum value of the bilateral gap 108 corresponding to the avoidance part 106 and $\delta_0$.

For example, the difference between the diameter of the inner side wall of the connecting structure 104 and the diameter of the crankshaft 102 is the bilateral gap 108.

Further, the product of $\delta/\delta_0$ and D/h is larger than or equal to 0.5 and less than or equal to 2.5.

In the embodiment, when the product of $\delta/\delta_0$ and D/h is set as larger than or equal to 0.5 and less than or equal to 2.5, the reduction of the friction between the crankshaft 102 and the connecting structure 104 can be further enhanced.

For example, as shown in FIG. 4, FIG. 4 is a curve chart of the affection of the corresponding dimension of the avoidance part 106 on the minimum oil film thickness, wherein a horizontal axis adopts logarithmic coordinates, the carrying capacity of the oil film between the crankshaft 102 and the connecting structure 104 can be represented by the minimum oil film thickness, the bigger the minimum oil film thickness is, the higher the carrying capacity of the oil film is, and the wear is not easily caused between the crankshaft 102 and the connecting structure 104.

Further, h is larger than or equal to 2 mm and less than or equal to 20 mm.

In the embodiment, the axial height of the avoidance part 106 is set as larger than or equal to 2 mm and less than or equal to 20 mm, so as to be convenient for processing of the avoidance part 106, and meanwhile, be beneficial for reduction of wear between the crankshaft 102 and the connecting structure 104.

Embodiment 4

As shown in FIG. 5 and FIG. 7, one embodiment according to the present disclosure comprises the features limited by the above embodiments, and further, the avoidance part 106 comprises a plurality of avoidance sections, and the plurality of avoidance sections are sequentially connected with one another along the axial direction of the crankshaft 102, wherein at least one of the avoidance sections satisfies the condition that the product of $\delta/\delta_0$ and D/h is larger than or equal to 0.2 and less than or equal to 5.

In the embodiment, the avoidance part 106 comprises a plurality of avoidance sections, the avoidance sections are sequentially connected with one another along the axial direction, and the dimension of at least one of the avoidance sections satisfies a relational expression that the product of $\delta/\delta_0$ and D/h is more than or equal to 0.2 and less than or equal to 5.

The avoidance sections satisfy the relational expression that the product of $\delta/\delta_0$ and D/h is larger than or equal to 0.2 and less than or equal to 5, namely, the minimum value of the bilateral gap 108 corresponding to the avoidance sections is $\delta_0$, the difference between the maximum value of the bilateral gap 108 corresponding to the avoidance sections and $\delta_0$ is $\delta$, the diameter of the crankshaft 102 corresponding to the minimum part of the bilateral gap 108 corresponding to the avoidance sections is D, the length of the avoidance sections along the axial direction of the crankshaft 102 is h, and the corresponding $\delta$, $\delta_0$, D and h of the avoidance sections satisfy the above limited relational expression.

For example, the avoidance part 106 is arranged at the end part of the connecting structure 104 along the axial direction of the crankshaft 102, the oblique angles of the avoidance sections can be same or different, and further, the avoidance sections are slidingly connected with one another.

Embodiment 5

As shown in FIG. 3 and FIG. 5, one embodiment according to the present disclosure comprises the features limited by the above embodiments, and further, the dimension of the gap 108 corresponding to at least part of the avoidance part 106 changes linearly along the axial direction of the crankshaft 102.

In the embodiment, the dimension of the gap 108 corresponding to at least part of the avoidance part 106 changes linearly along the axial direction of the crankshaft 102, and namely, in the compressor 100, the radial dimension of the gap 108 from the direction away from the middle part of the connecting structure 104 along the axial direction of the crankshaft 102 in the cross section in the axial direction of the crankshaft 102 changes in direct proportion.

Further, a wall surface formed by the avoidance part 106 comprises a conical surface.

In the embodiment, the wall surface formed by the avoidance part 106 comprises the conical surface, thereby enabling the gap 108 between the crankshaft 102 and the connecting structure 104 to change linearly, and meanwhile, being convenient for processing of the avoidance part 106.

Embodiment 6

As shown in FIG. 6 and FIG. 7, one embodiment according to the present disclosure comprises the features limited by the above embodiments, and further, in the compressor 100, an acute angle between a tangent line of the wall surface formed by at least part of the avoidance part 106 and the direction perpendicular to the axis of the crankshaft 102 is gradually reduced along the direction away from the middle part of the connecting structure 104 in the cross section in the axial direction of the crankshaft 102.

In the embodiment, the tangent line of the wall surface formed by at least part of the avoidance part 106 gradually tends to be horizontal along the direction away from the middle part of the connecting structure 104 in the axial direction of the crankshaft 102, and namely, the acute angle between the tangent line of the wall surface formed by the avoidance part 106 and the direction perpendicular to the axis of the crankshaft 102 is gradually reduced, so that the avoidance part 106 is better matched with the shape of deflection deformation of the crankshaft 102, thereby further reducing wear.

For example, the speed of enlarging the gap 108 corresponding to the avoidance part 106 is gradually increased along the axial direction away from the middle part of the connecting structure 104.

Further, the wall surface formed by the avoidance part 106 comprises a curved surface.

In the embodiment, the wall surface formed by the avoidance part 106 comprises the curved surface, so that the change of the gap 108 corresponding to the avoidance part 106 is better matched with the shape of deflection deformation of the crankshaft 102, thereby further reducing wear.

As shown in FIG. 3, the avoidance part 106 is arranged on the crankshaft 102, the avoidance part 106 is realized through the change of the diameter of the crankshaft 102, and namely, the diameter of the crankshaft 102 becomes small after the crankshaft 102 is provided with the avoidance part 106. The crankshaft 102 forms a cone at the avoidance part 106, so that at the part of the crankshaft 102, at which the avoidance part 106 is arranged, the gap 108 between the crankshaft 102 and the connecting structure 104 changes linearly along the axial direction.

As shown in FIG. 5, the avoidance part 106 is arranged on the connecting structure 104, the avoidance part 106 is realized through the change of the diameter of the connecting structure 104, and namely, the diameter of the connecting structure 104 becomes big after the avoidance part 106 is arranged on the inner side wall of the connecting structure 104. The inner side wall of the connecting structure 104 forms a cone at the avoidance part 106, so that at the part of the connecting structure 104, at which the avoidance part 106 is arranged, the gap 108 between the crankshaft 102 and the connecting structure 104 changes linearly along the axial direction.

As shown in FIG. 6 and FIG. 7, when the flexural deflection of the crankshaft 102 is bigger, in order to further reduce wear, the avoidance part 106 can be a curved surface, the speed of enlarging the gap 108 corresponding to the avoidance part 106 is gradually increased along the axial direction away from the center of kinematic pairs (away from the middle part of the connecting structure 104), and namely, the tangent line of avoidance part 106 and the axis of the crankshaft 102 gradually tend to be parallel, so that the change of the gap 108 corresponding to the avoidance part 106 is better matched with the shape of deflection deformation of the crankshaft 102, so as to further reduce wear.

For example, the avoidance part 106 can be also arranged on the crankshaft 102 and the connecting structure 104 at the same time. The wall surface formed by the avoidance part 106 comprises the conical surface and the curved surface.

Embodiment 7

One embodiment according to the present disclosure comprises the features limited by the above embodiments, and further, the avoidance part 106 is annular in the cross section perpendicular to the axis of the crankshaft 102.

In the embodiment, the avoidance part 106 is annular, and the annular avoidance part 106 can have good avoidance effect on all directions of the crankshaft 102 when the crankshaft 102 is obliquely deformed, thereby reducing wear between the crankshaft 102 and the connecting structure 104 in all directions, and namely, reducing the degree of wear in all directions.

Embodiment 8

As shown in FIG. 8 and FIG. 9, one embodiment according to the present disclosure comprises the features limited by the above embodiments, and further, the crankshaft 102 comprises a main body and an eccentric part 1024. The main body comprises a first shaft part 1020 and a second shaft part 1022 that are coaxially arranged, the eccentric part 1024 is connected with the main body, and the main body and the eccentric part 1024 are eccentrically arranged.

In the embodiment, the crankshaft 102 comprises the main body and the eccentric part 1024, the main body comprises the first shaft part 1020 and the second shaft part 1022, the first shaft part 1020 is connected with a rotor 114 of a motor to drive the eccentric part 1024 to rotate, and a suction process and an exhaust process of the compressor 100 are realized through the rotation of the eccentric part 1024.

Further, the connecting structure 104 comprises a first bearing 1040, a second bearing 1042 and a piston 1044, the first bearing 1040 is sleeved on the first shaft part 1020, the second bearing 1042 is sleeved on the second shaft part 1022, and the piston 1044 is sleeved on the eccentric part 1024.

In the embodiment, the connecting structure 104 comprises the first bearing 1040, the second bearing 1042 and the piston 1044. The first bearing 1040 is sleeved on the first shaft part 1020, the second bearing 1042 is sleeved on the second shaft part 1022, the crankshaft 102 is fixed through the first bearing 1040 and the second bearing 1042, the piston 1044 is sleeved on the eccentric part 1024, and the piston 1044 is driven to move through the rotation of the eccentric part 1024, so that the suction process and the exhaust process of the compressor 100 are realized.

Further, based on the condition that the avoidance part 106 is arranged on the crankshaft 102, and the avoidance part 106 is arranged at the portion of the first shaft part 1020 that is close to the second shaft part 1022, and/or the avoidance part 106 is arranged at the portion of the first shaft part 1020 that is away from the second shaft part 1022, and/or the avoidance part 106 is arranged at one end of the eccentric part 1024 that is close to the first bearing 1040, and/or the avoidance part 106 is arranged at one end of the eccentric part 1024 that is close to the second bearing 1042, and/or the avoidance part 106 is arranged at one end of the second shaft part 1022 that is close to the eccentric part 1024.

In the embodiment, when the avoidance part 106 is arranged on the crankshaft 102, the avoidance part 106 is arranged at the part of the first shaft part 1020 that is close to the second shaft part 1022, the part of the first shaft part 1020 that is away from the second shaft part 1022, the end of the eccentric part 1024 that is close to the first bearing 1040, the end of the eccentric part 1024 that is close to the second bearing 1042, and/or the end of the second shaft part 1022 that is close to the eccentric part 1024.

Further, based on the condition that the avoidance part 106 is arranged on the connecting structure 104, the avoidance part 106 is arranged at one end of the first bearing 1040 that is close to the second bearing 1042, and/or the avoidance part 106 is arranged at one end of the first bearing 1040 that is away from the second bearing 1042, and/or the avoidance part 106 is arranged at one end of the piston 1044 that is close to the first bearing 1040, and/or the avoidance part 106 is arranged at one end of the piston 1044 that is close to the second bearing 1042, and/or the avoidance part 106 is arranged at one end of the second bearing 1042 that is close to the first bearing 1040.

In the embodiment, when the avoidance part 106 is arranged on the connecting structure 104, the avoidance part 106 is arranged at any one or the combination of the end that the first bearing 1040 is close to the second bearing 1042, the end that the first bearing 1040 is away from the second bearing 1042, the end that the piston 1044 is close to the first bearing 1040, the end that the piston 1044 is close to the second bearing 1042, and the end that the second bearing 1042 is close to the first bearing 1040.

Certainly, the avoidance part 106 can be also arranged on the connecting structure 104 and the crankshaft 102 at the same time.

Further, the compressor 100 also comprises a cylinder 110, a sliding piece 112 and the rotor 114. The cylinder 110 comprises a cylinder chamber, the piston 1044 is arranged in the cylinder chamber, the crankshaft 102 is arranged in the cylinder chamber in a penetrating manner, a sliding piece groove is formed in the cylinder 110, the sliding piece 112 is arranged in the sliding piece groove and is connected with the piston 1044 in a rolling manner, and the rotor 114 is connected with the first shaft part 1020.

In the embodiment, the compressor 100 also comprises the cylinder 110, the sliding piece 112 and the rotor 114, the rotor 114 is connected with the first shaft part 1020, the cylinder 110 is provided with the cylinder chamber, the piston 1044 is arranged in the cylinder chamber, and the crankshaft 102 is arranged in the cylinder chamber in a penetrating manner, wherein the sliding piece groove is formed in the cylinder 110, and the sliding piece 112 is arranged in the sliding piece groove and is rotatably connected with the piston 1044, so that the suction process and the exhaust process of the compressor 100 are realized.

Further, the compressor 100 is an inverter compressor.

In the embodiment, the compressor 100 is the inverter compressor, the reliability of the inverter compressor can be improved in a way that the avoidance part 106 is arranged on the connecting structure 104 or the crankshaft 102, and certainly, the compressor 100 can be also a constant speed compressor.

Further, the compressor 100 is filled with coolants, and the coolants are difluoromethane or propane.

In the embodiment, the compressor 100 is filled with the coolants, the refrigeration or heating of the refrigeration device is realized through a heat adsorption process and a heat release process of the coolants, for example, the coolants are difluoromethane or propane, and certainly, the coolants can also be other coolants.

Embodiment 9

According to one exemplary embodiment of the present disclosure, as shown in FIG. 8 and FIG. 9, a compressor 100 comprises a crankshaft 102, a first bearing 1040, a second bearing 1042, a cylinder 110, a piston 1044, a sliding piece 112, a balance block 116 arranged on a rotor 114 and the like, the above components form a suction chamber and a compression chamber, and the rotor 114 of a motor drives the crankshaft 102 to rotate, so that the volume of the suction chamber is enlarged, and the volume of the compression chamber is decreased, so as to realize the suction process and the exhaust process. The crankshaft 102 comprises a first shaft part 1020, a second shaft part 1022 and an eccentric part 1024. The first shaft part 1020 and the first bearing 1040, the second shaft part 1022 and the second bearing 1042, as well as the eccentric part 1024 and the piston 1044 respectively form three sliding bearings, the gap 108 is formed between each of the shaft parts (the first shaft part 1020, the second shaft part 1022 or an eccentric shaft) of the sliding bearings and the connecting structure 104 (the first bearing 1040, the second bearing 1042 or the piston 1044), and the gap 108 is filled with lubricating oil in normal operation. The above three sliding bearings often has abnormal wear phenomena. For example, due to the effects of the centrifugal force generated in the rotation process of the rotor 114 and the magnetic pull of the motor, the center of the rotor 114 deviates from the axis of the motor, so as to cause deflection; and correspondingly, deflection deformation is caused on the upper end of the crankshaft 102, so that the first shaft part 1020 of the crankshaft 102 and the upper end of the first bearing 1040 are in line contact, the local oil film is cracked, and the first shaft part 1020 of the crankshaft 102 and the first bearing 1040 are directly in metal contact, thereby resulting in wear. Similarly, deflection deformation is also caused on the eccentric shaft of the crankshaft 102 under the effect of gas force of the suction chamber and the compression chamber, so that the first shaft part 1020 and the lower edge of the first bearing 1040, the second shaft part 1022 and the upper edge of the second bearing 1042, as well as the eccentric shaft and the upper and lower edges of the piston 1044 may directly be in metal contact, thereby resulting in abnormal wear. Therefore, due to the oblique deformation of the crankshaft 102, normal oil films are difficultly formed on the edges of all sliding bearings, so as to form local metal contact, thereby resulting in wear. As shown in FIG. 3, in the embodiment provided by the present disclosure, the avoidance part 106 is arranged on the connecting structure 104 or at the part where the crankshaft 102 is matched with the connecting structure 104, the gap 108 is formed between the connecting structure 104 and the crankshaft 102, and the gap 108 at the part of the crankshaft 102 and the connecting structure 104, which correspond to the avoidance part 106, is enlarged along the direction away from the center of the kinematic pairs, so that the original metal contact position can still keep surface contact after the deflection deformation of the crankshaft 102, and normal oil films are formed, so as to avoid wear and greatly improve the reliability of the compressor 100.

For example, a part can be removed from the crankshaft 102 or the connecting structure 104 in manners such as turning and the like, so as to form the avoidance part 106, or the crankshaft 102 and the avoidance part 106 arranged on the crankshaft 102 are integrally manufactured, or the connecting structure 104 and the avoidance part 106 arranged on the connecting structure 104 are integrally manufactured.

For example, the minimum value of the bilateral gap 108 corresponding to the avoidance part 106 is $\delta_0$, the difference between the maximum value of the bilateral gap 108 corresponding to the avoidance part 106 and $\delta_0$ is $\delta$, the diameter of the crankshaft 102 corresponding to the minimum part of the bilateral gap 108 corresponding to the avoidance part 106 is D, the length of the avoidance part 106 is h along the axial direction of the crankshaft 102, and the product of $\delta/\delta_0$ and D/h is larger than or equal to 0.2 and less than or equal to 5. As shown in FIG. 4, FIG. 4 is the curve chart of the affection of the corresponding dimension of the avoidance part 106 of the sliding bearings on the minimum oil film thickness, wherein the horizontal axis adopts the logarithmic coordinates, the carrying capacity of the oil films of the sliding bearings can be represented by the minimum oil film thickness, the bigger the minimum oil film thickness is, the higher the carrying capacity of the oil films is, and the wear is not easily caused on the sliding bearings. As shown in FIG. 4, when the dimension of the avoidance part 106 satisfies the condition that the product of $\delta/\delta_0$ and D/h is larger than or equal to 0.2 and less than or equal to 5, the reduction of wear is the optimal.

Further, the product of $\delta/\delta_0$ and D/h is larger than or equal to 0.5 and less than or equal to 2.5, and h is larger than or equal to 2 mm and less than or equal to 20 mm.

Embodiment 10

As shown in FIG. 8, according to one exemplary embodiment of the present disclosure, a compressor 100 provided by the present disclosure comprises a crankshaft 102 and a connecting structure 104. The crankshaft 102 comprises a first shaft part 1020, a second shaft part 1022 and an eccentric part 1024. The connecting structure 104 comprises a first bearing 1040, a second bearing 1042 and a piston 1044. The first bearing 1040 is sleeved on the first shaft part 1020, the second bearing 1042 is sleeved on the second shaft part 1022, and the piston 1044 is sleeved on the eccentric part 1024. In the present embodiment, avoidance parts 106 are arranged on the crankshaft 102. For example, the avoidance parts 106 are respectively arranged at the part of the upper end of the first bearing 1040 that corresponds to the first shaft part 1020, at the part of the lower end of the first bearing 1040 that corresponds to the first shaft part 1020, at the part of the upper end of the second bearing 1042 that corresponds to the second shaft part 1022, at the part of the upper end of the piston 1044 that corresponds to an eccentric shaft, and at the part of the lower upper end of the piston 1044 that corresponds to the eccentric shaft. The shape of the avoidance parts 106 is a conical surface, and the specific dimension of any of the avoidance parts 106 satisfies the condition that the product of $\delta/\delta_0$ and D/h is larger than or equal to 0.2 and less than or equal to 5, wherein h1, h2, h3, h4 and h4 in FIG. 8 respectively represent the axial height of the avoidance parts 106.

Embodiment 11

As shown in FIG. 9, according to one exemplary embodiment of the present disclosure, a compressor 100 provided by the present disclosure comprises a crankshaft 102 and a connecting structure 104. The crankshaft 102 comprises a first shaft part 1020, a second shaft part 1022 and an eccentric part 1024. The connecting structure 104 comprises a first bearing 1040, a second bearing 1042 and a piston 1044. The first bearing 1040 is sleeved on the first shaft part 1020, the second bearing 1042 is sleeved on the second shaft part 1022, and the piston 1044 is sleeved on the eccentric part 1024. In the present embodiment, avoidance parts 106 are arranged on the connecting structure 104, the avoidance parts 106 can be respectively arranged the upper end and the lower end of the first bearing 1040, the upper end of the second bearing 1042, as well as the upper end and the lower end of the piston 1044, the shape of the avoidance parts 106 is a curved surface, and the specific dimension of any of the avoidance parts 106 satisfies the condition that the product of $\delta/\delta_0$ and D/h is larger than or equal to 0.2 and less than or equal to 5, wherein h1, h2, h3, h4 and h4 in FIG. 9 respectively represent the axial height of the avoidance parts 106.

Embodiment 12

According to the second aspect of the present disclosure, the present disclosure also provides refrigeration device, which comprises the compressor 100 provided by any of the above embodiments.

The refrigeration device provided by the second aspect of the present disclosure comprises the compressor 100 provided by any of the above embodiments, therefore, the refrigeration device has all beneficial effects of the compressor 100.

For example, the refrigeration device comprises a heat exchanger, the heat exchanger is communicated with the compressor 100 by a pipeline, and the coolants can flow in the pipeline.

In the present disclosure, the term "a plurality of" refers to two or more, unless explicitly defined otherwise. The terms such as "installation", "connected", "connecting", "fixation" and the like shall be understood in broad sense, and for example, "connecting" may be a fixed connection, a detachable connection, or an integral connection; "connected" may be directly connected, or indirectly connected through an intermediary. The specific meaning of the above terms in the present disclosure will be understood by those of ordinary skills in the art, as the case may be.

In the illustration of the description, the illustration of the terms of "one embodiment", "some embodiments", "specific embodiment", etc. means that the specific features, structures, materials, or features described in conjunction with the embodiments or examples are included in at least one embodiment or example of the present disclosure. In this description, schematic representations of the above terms do not necessarily refer to the same embodiment or example. Moreover, the specific features, structures, materials, or characteristics described may be combined in any suitable manner in any one or more embodiments or examples.

The foregoing is only a preferred embodiment of the present disclosure and is not intended to limit the present disclosure. For those skilled in the art, the present disclosure can have various modifications and changes. Any modification, equivalent replacement, improvement, etc. that made within the spirit and principle of the present disclosure are intended to be included within the scope of the present disclosure.

Furthermore, various disclosed and described structures may have different names, named portions thereof, and/or named groupings without departing from the scope of this disclosure. For example, referring back to FIG. 8, the crankshaft 102 may be defined as shown (e.g., within the ellipse) and may be formed of a first shaft portion 800 (e.g., within the ellipse) and a second shaft portion 802 (e.g., within the ellipse). An eccentric portion 804 may connect the first shaft portion 800 and the second shaft portion 802. The crankshaft 102 may be configured to rotate about a rotating axis 806. The first shaft portion 800 may include a first cylindrical portion 808 and a second cylindrical portion 810. The second shaft portion 802 may include a third cylindrical portion 812. The first shaft portion 800 may have a first avoidance portion 814 between the first cylindrical portion 808 and the second cylindrical portion 810. The first shaft portion 800 may also have a second avoidance portion 816 between the second cylindrical portion 812 and the eccentric portion 804. The second shaft portion 802 may have a third avoidance portion 818 between the third cylindrical portion 812 and the eccentric portion 804. The first avoidance portion 814 may form a flat surface 818. The flat surface 818 may be normal to the rotating axis 806. The crankshaft 102 may be configured to rotate about the rotating axis 806 via cylindrical bearings. For example, a fourth cylindrical portion 818 may be sleeved around the second cylindrical portion 810 and a portion of the first avoidance portion 814. A fifth cylindrical portion 820 may be sleeved around the third cylindrical portion 812 and the third avoidance portion 818.

Accordingly, a crankshaft is described herein. The crankshaft includes an eccentric portion and a first shaft portion connected eccentrically with the eccentric portion. The first shaft portion includes a first cylindrical portion, a second cylindrical portion, a first avoidance portion disposed between the first cylindrical portion and the second cylindrical portion, and a second avoidance portion disposed between the second cylindrical portion and the eccentric portion. The crankshaft also includes a second shaft portion connected eccentrically with the eccentric portion. The second shaft portion includes a third cylindrical portion and a third avoidance portion disposed between the third cylindrical portion and the eccentric portion.

Accordingly, a compressor is also described herein. The compressor includes the crankshaft above. The compressor also includes a first bearing including a fourth cylindrical portion sleeved over the second cylindrical portion, at least a portion of the first avoidance portion, and the second avoidance portion of the first shaft portion of the crankshaft. The compressor further includes a second bearing comprising a fifth cylindrical portion sleeved over the third cylindrical portion and the third avoidance portion of the second shaft portion of the crankshaft. Each of the first, second, and third cylindrical portions have a respective diameter, each of the respective diameters are equal to each other. The first avoidance portion forms a first bilateral gap between the first shaft portion and the first bearing. The second avoidance portion forms a second bilateral gap between the first shaft portion and the first bearing. The third avoidance portion forms a third bilateral gap between the second shaft portion and the second bearing. A minimum value of each of the first, second, and third bilateral gaps is $\delta_0$. A difference between a maximum value of each of the first, second, and third bilateral gaps and do is $\delta$. $\delta$ is less than $\delta_0$.

What is claimed is:

1. A compressor comprising a crankshaft comprising:

an eccentric portion;

a first shaft portion connected eccentrically with the eccentric portion, the first shaft portion comprising:

a first cylindrical portion;

a second cylindrical portion;

a first avoidance portion disposed between the first cylindrical portion and the second cylindrical portion; and a second avoidance portion disposed between the second cylindrical portion and the eccentric portion; and a second shaft portion connected eccentrically with the eccentric portion, the second shaft portion comprising:

a third cylindrical portion; and a third avoidance portion disposed between the third cylindrical portion and the eccentric portion;

a first bearing comprising a fourth cylindrical portion sleeved over the second cylindrical portion, at least a portion of the first avoidance portion, and the second avoidance portion of the first shaft portion of the crankshaft; and a second bearing comprising a fifth cylindrical portion sleeved over the third cylindrical portion and the third avoidance portion of the second shaft portion of the crankshaft, wherein:

each of the first, second, and third cylindrical portions have a respective diameter, each of the respective diameters are substantially equal to each other;

the first avoidance portion forms a first bilateral gap between the first shaft portion and the first bearing;

the second avoidance portion forms a second bilateral gap between the first shaft portion and the first bearing;

the third avoidance portion forms a third bilateral gap between the second shaft portion and the second bearing;

a minimum value of each of the first, second, and third bilateral gaps is $\delta_0$;

a difference between a maximum value of each of the first, second, and third bilateral gaps and $\delta_0$ is $\delta$; and $\delta$ is less than $\delta_0$.

2. The compressor according to claim 1, wherein:

the first and second bilateral gaps are enlarged away from the second cylindrical portion; and the third bilateral gap is enlarged away from the third cylindrical portion.

3. The compressor according to claim 1, wherein:

the respective diameters of each of the first, second, and third cylindrical portions is D;

a length of each of the avoidance portions is h; and a product of $\delta/\delta_0$ and D/h is larger than or equal to 0.2 and less than or equal to 5.

4. The compressor according to claim 3, wherein the product of $\delta/\delta_0$ and D/h is larger than or equal to 0.5 and less than or equal to 2.5.

5. The compressor according to claim 3, wherein the length of each of the avoidance portions is larger than or equal to 2 mm and less than or equal to 20 mm.

6. The compressor according to claim 1, wherein at least one of the first, second, and third bilateral gaps changes linearly.

7. The compressor according to claim 1, wherein at least one of the first, second, and third bilateral gaps changes non-linearly.

8. The compressor according to claim 1, wherein at least one of the avoidance portions is annular in a cross section.

9. The compressor according to claim 1, further comprising:

a piston;

a cylinder comprising a cylinder chamber, wherein the piston is arranged in the cylinder chamber, the crankshaft is arranged in the cylinder chamber in a penetrating manner, and a sliding piece groove is formed in the cylinder;

a sliding piece arranged in the sliding piece groove and connected with the piston in a rolling manner; and a rotor connected with the first shaft portion.

10. A refrigeration device comprising the compressor according to claim 1.

11. The compressor according to claim 1, further comprising a rotor, wherein a portion of the first cylindrical portion of the crankshaft extends into the rotor.

12. The compressor according to claim 1, wherein a transition between the first cylindrical portion and the first avoidance portion of the crankshaft comprises a flat surface.

13. The compressor according to claim 12, wherein the flat surface has a normal axis that is parallel with a rotating axis of the crankshaft.

14. The compressor according to claim 1, wherein the first avoidance portion extends axially past the fourth cylindrical portion of the first bearing.

15. The compressor according to claim 1, wherein:

the fourth cylindrical portion of the first bearing extends axially past the second avoidance portion of the crankshaft; and the fifth cylindrical portion of the second bearing extends axially past the third avoidance portion.

* * * * *